United States Patent [19]

Rost

[11] Patent Number: 4,545,222

[45] Date of Patent: Oct. 8, 1985

[54] TEXTILE YARN CARRIER

[76] Inventor: Karl H. Rost, P.O. Box 6783, Greenville, S.C. 29606

[21] Appl. No.: 696,851

[22] Filed: Jan. 30, 1985

Related U.S. Application Data

[63] Continuation of Ser. No. 487,003, Apr. 21, 1983, abandoned.

[51] Int. Cl.[4] ..... D06F 17/00

[52] U.S. Cl. ..... 68/198; 242/118.1; 242/118.3

[58] Field of Search ..... 68/189, 198; 242/118.3, 242/118.32, 118.1, 118.11, 118.2

[56] References Cited

U.S. PATENT DOCUMENTS

| | | | |
|---|---|---|---|
| 329,483 | 11/1885 | Pfaff | 68/189 X |
| 1,374,628 | 4/1921 | Ashworth | 242/118.1 X |
| 1,949,290 | 2/1934 | Barthelmes | 242/118.32 |
| 2,338,513 | 1/1944 | Helm | 242/118.11 |
| 2,675,194 | 4/1954 | Steverlynck | 242/118.1 |
| 3,675,871 | 7/1972 | Heyden | 242/118.3 |

FOREIGN PATENT DOCUMENTS

| | | | |
|---|---|---|---|
| 513761 | 9/1952 | Belgium | 242/118.11 |
| 281797 | 10/1912 | Fed. Rep. of Germany | 242/118.1 |
| 1460257 | 11/1968 | Fed. Rep. of Germany | 242/118.1 |
| 2425420 | 12/1975 | Fed. Rep. of Germany | 242/118.3 |
| 1017666 | 12/1952 | France | 242/118.1 |
| 1311825 | 11/1962 | France | 242/118.1 |
| 1462701 | 12/1966 | France | 242/118.11 |
| 2219627 | 9/1974 | France | 242/118.11 |

*Primary Examiner*—Philip R. Coe
*Assistant Examiner*—Frankie L. Stinson
*Attorney, Agent, or Firm*—Bailey & Hardaway

[57] ABSTRACT

A generally cylindrical yarn carrier is illustrated suitable for improved compression dyeing wherein an undulating surface provides ridges and valleys for facilitating dye flow as well as nesting while providing increased strength and stability, avoiding skips and insuring uniform dyeing.

3 Claims, 5 Drawing Figures

Fig. 4.
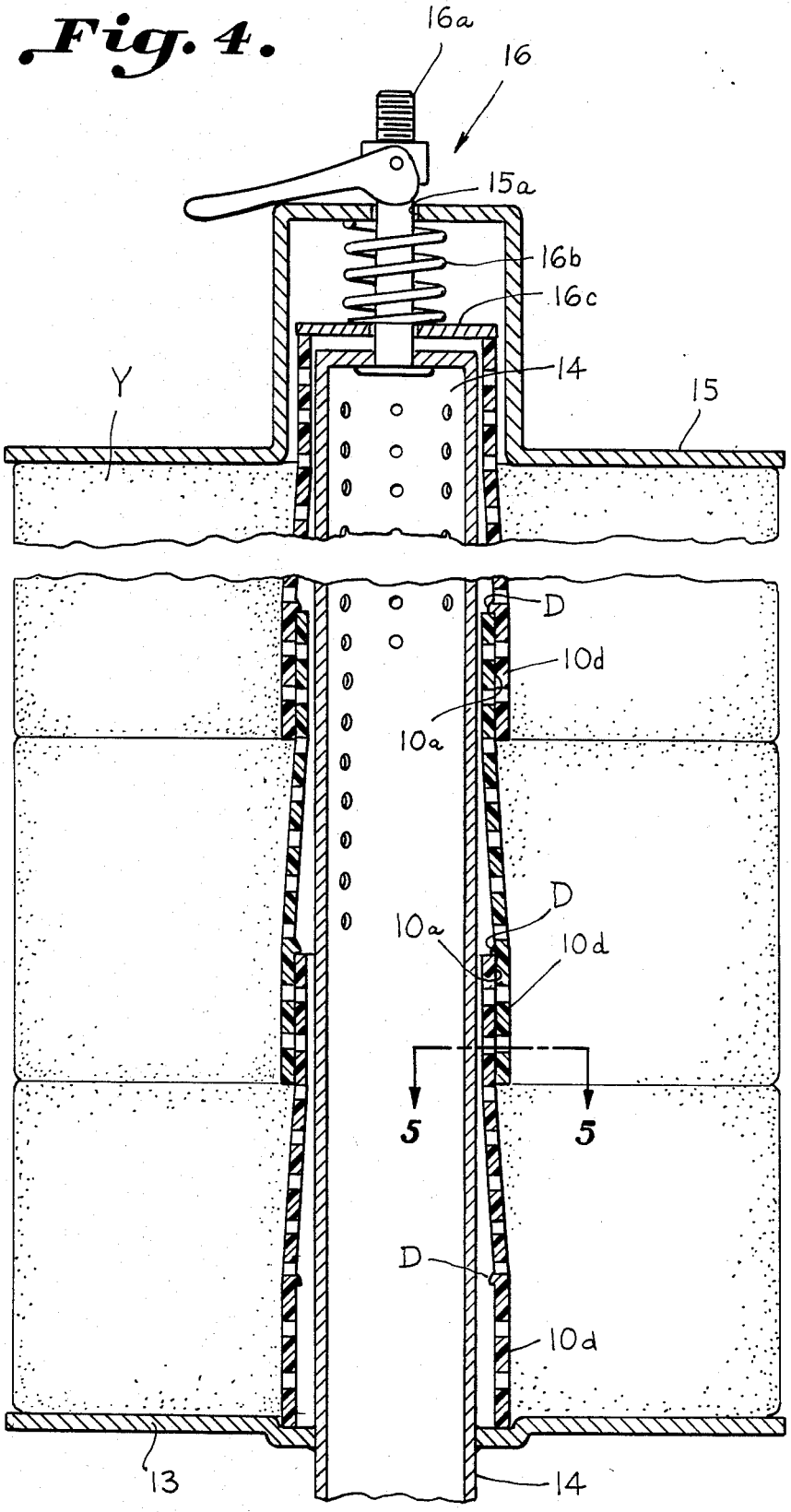
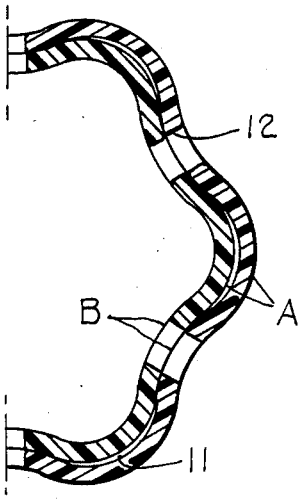
Fig. 5.

TEXTILE YARN CARRIER

This application is a continuation of application Ser. No. 487,003, filed 4/21/83, and now abandoned.

BACKGROUND OF THE INVENTION

This invention relates to a textile yarn carrier or tube especially adapted to the press or compression dyeing of yarn so as to avoid skips or inadequate dyeing of the yarn next to the vertical ribs of prior art yarn carriers.

Yarn carriers in accordance with the invention are preferably made of thermoplastic material and are generally cylindrical. However, they taper or are reduced sufficiently on at least one end to allow an end of one yarn carrier to be inserted into a base end of the next adjacent yarn carrier to the extent necessary to permit a predetermined amount of compression of the yarn on the carriers. A wavy or undulating peripheral surface is provided so that the waves run in an axial direction guiding the tubes for insertion into one another. The head or top end of one tube can be inserted so that its outside diameter extends into the open foot or base end of the next adjacent tube in the inside diameter. The thermal and/or wet treatment of the yarn, as during compression dyeing, is usually carried out with yarn packages which are wound crossed or parallel to allow easy further processing with low thread tension and minimal waste.

Such yarn carrier must possess great strength to withstand substantial compressive forces resulting from shrinkage of the yarn package during thermal treatment or a change in volume during wet treatment and the configuration of yarn carriers constructed in accordance with the invention provides such strength together with economy while facilitating complete and uniform dyeing of the yarn avoiding skips. Upon liquid application rayon and acrylic yarns, for example, have a tendency to expand and, therefore, increase compressive forces whereas polyester tends to shrink increasing radial constricting forces.

Prior textile yarn tubes are usually provided with bar-shaped supporting elements or ribs disposed in an axial direction, so as to resist axial compression which is imparted during compression dyeing. For compression dyeing the yarn packages are stacked upon a vertical pipe or spindle having spaced openings for introducing liquid dye. The yarn carriers are firt nested and then the yarn is compressed as permitted by the respective yarn carriers to the extent one carrier may be inserted into the next adjacent yarn carrier.

The prior art textile yarn tubes, during such dyeing, impart blank spots or skips, that is to say places which are not dyed, to the first yarn layers which rest adjacent the axial ribs. Skips are produced because it is impossible for the dye liquor to penetrate completely through these initial thread layers. These dyeing defects arise especially in synthetic yarn packages, since synthetic yarns are dyed only by means of a liquor under pressure passing from inside outwards. Such ribbed constructions are exemplified in U.S. Letters Pat. Nos. 4,078,740 and 4,180,219. A tapered yarn carrier having an undulating surface over an intermediate part of its length is illustrated in French Patent No. 1,017,666 of 1952.

SUMMARY OF THE INVENTION

Accordingly, it is an important object of this invention to provide a yarn carrier having a series of waves which extend in an axial direction. This wavy peripheral surface is provided with additional perforations offset from the larger openings located in the valleys, the additional smaller perforations being arranged, in the wave crest or apex portions.

As a result, absolutely uniform dye penetration of the entire yarn package is achieved, since the yarn layers rest crosswise or parallel on the wave crests and dye liquor can pass through the perforations in the wave crest. Futhermore, the wave crest is provided in an axial direction with a textured surface which prevents the first yarn layers from sloughing off during unwinding. This construction also minimizes waste in creeling of the threads.

The dye liquor which passes through the larger perforations in the wave valley form a reservoir there, and because of the wavy peripheral surface channels are provided in the valleys, across which the yarn extends, for the dye liqur to penetrate laterally into the yarn package and insure uniform liquor penetration even in the region of the first yarn layers.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 4 is a sectional side elevation illustrating stacking and nesting of the packages preparatory to dyeing, and FIG. 5 is a sectional view taken on the line 5—5 in FIG. 4 illustrating the nesting surfaces of the yarn carriers.

DESCRIPTION OF A PREFERRED EMBODIMENT

Figure 1:
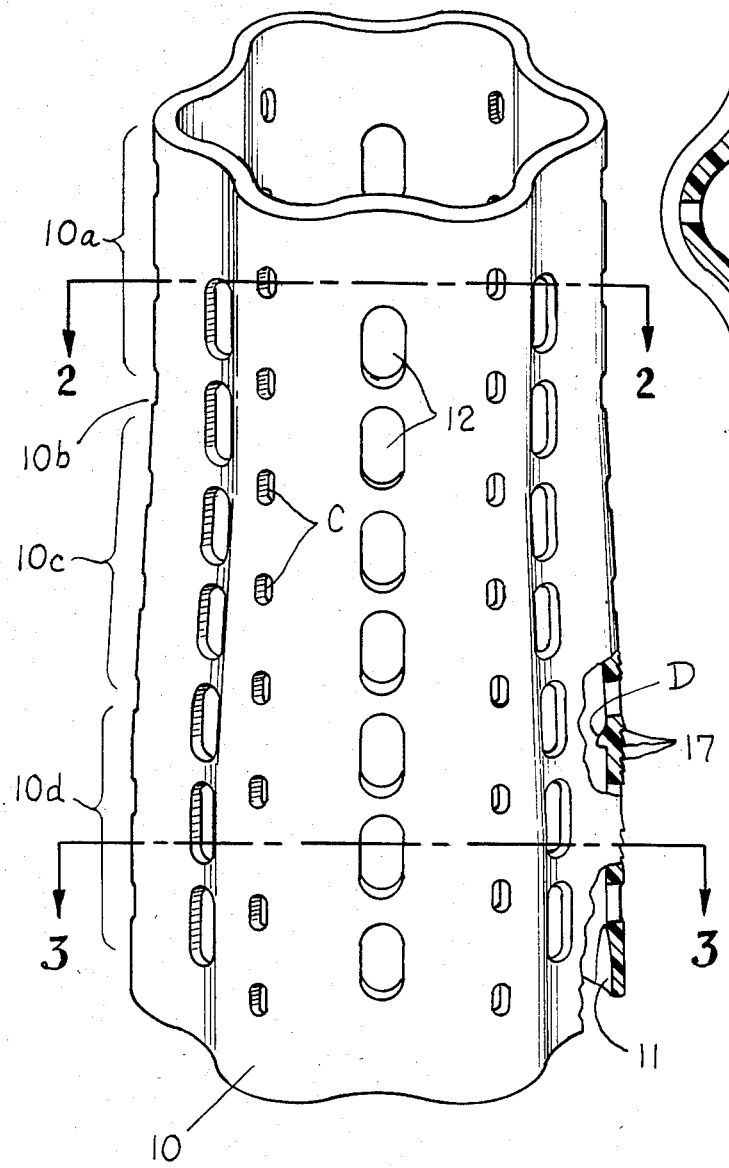
FIG. 1 is a perspective view illustrating a textile tube constructed in accordance with the present invention.
Figure 2:
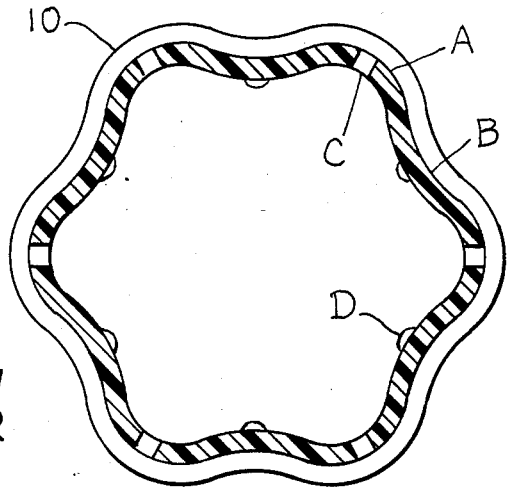
FIG. 2 is a sectional view taken on the line 2—2 in FIG. 1 illustrating the undulating cross section.
Figure 3:
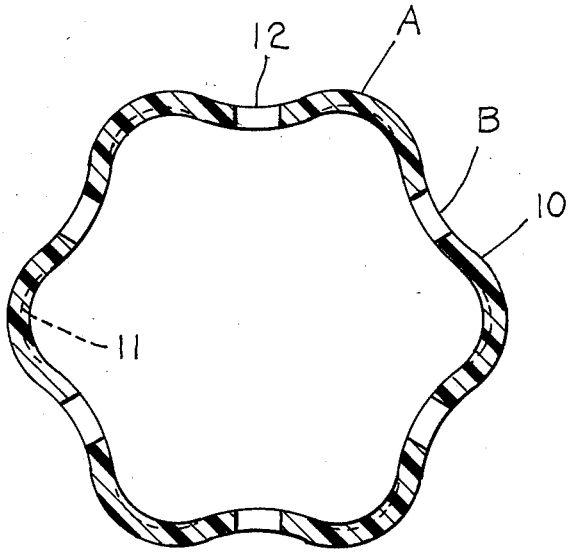
FIG. 3 is a sectional view taken on the line 3—3 in FIG. 1 illustrating the guiding surfaces for inserting one carrier within another for stacking and nesting.

A textile yarn carrier is illustrated having an open plastic shell of a generally cylindrical configuration facilitating the passage of a liquid dye therethrough from the inside but being reduced at least one end sufficiently to permit stacking wherein an upper portion of each yarn carrier is nested within a lower portion of a next adjacent yarn carrier. A plurality of generally axial apexes A with valleys B therebetween are formed by undulations within the plastic shell. A plurality of axially spaced openings C are provided in the apexes in addition to the larger openings in the valleys. The apexes and valleys of the top of each yarn carrier serve as means guiding yarn carriers into nested relation with respective apexes and valleys aligned in a base of a next adjacent yarn carrier. Stop means D limit the amount to which one yarn carrier may be inserted into another. Thus, respective yarn packages may be compressed by a predetermined amount without trapping yarn between overlapping yarn carrier surfaces.

The textile tube or yarn carrier illustrated consists of a slightly conical wavy peripheral surface 10 with the smaller perforations or openings C offset in respect to the larger and longer perforations provided between the apexes and spaced in an axial direction, so that, for example in the case of wet treatment of the yarn wound onto the tetile tube, the dye liquor can circulate around the yarn on all sides.

The generally cylindrical yarn carrier may have a biconical surface as is customary with the ribbed yarn carriers described above. Such surface tapers from the upper end slightly inwardly from the upper end as at 10*a* to a low point 10*b* before again tapering as at 10*c* outwardly to a more nearly truly cylindrical base or lower portion 10*d*. This particular surface is customary and permit compression of the yarn package as would be impossible with a truly conical carrier. It is important that the surface taper or be otherwise reduced only to the extent to permit a snug nesting thus avoiding entrapment and fouling of yarn as would occur due to the space between the overlying cone into which the small top of the next adjacent cone would be inserted. It is important to note that the wavy configuration extends entirely along the yarn carrier as opposed to the configuration illustrated in the aforementioned French patent as would thwart nesting.

The wavy configuration of the textile tube is such that the head end of the tube can be pushed with the outside diameter extending by a predetermined amount into the inside diameter of the base of the next textile tube. The distance depends on the particular type of yarn wound on the tube and can be determined by means of the Stop D in the inside diameter of the tubes. The spaced recesses 11 in the inside diameter on the base of the textile tube avoid direct pressed engagement between the nested tubes at the mating apexes where jamming would be most likely to occur. Thus, the yarn package can be nested and be uniformly compressed. A closed column may be formed on the spindle in the dyeing apparatus, and economical dyeing becomes possible.

During drying as with hot air as with liquid treatment, the wavy peripheral surface likewise presents advantages because the fluid has to pass through the perforations 12 in the wave valleys and from there is distributed evenly over the yarn package, and does not, as in the prior art textile tubes, flow directly onto the yarn package. This provides an important advantage in that on the wavy peripheral surface shiny places are avoided at the contacting points of the yarn layers.

FIG. 4 illustrates a stack of yarn carriers with compressed yarn Y thereon. The yarn is compressed between a bottom plate 13 and the top plate 15. The spindle pipe 14 carries the top plate 15 which has a central opening 15*a*, in a raised central prtion which overlies the spindle, to accommodate a threaded member 16*a*. The threaded member 16*a* is a part of a conventional means broadly designated at 16 for securing the packages in stacked compressed relation. The means 16 has a spring 16*b* urging a retaining member 16*b* downwardly to maintain the plastic yarn carriers in stacked relation against the face of plastic expansion of the carriers when heated. The yarn is maintained compressed by the top plate 15 independently of the spring loaded fastener as is customary. It is cutomary to stack from 8–12 packages which are compressed from 20 to 30% of their heighth. The Stops D fix the amount of compression which is limited to some extent by the taper of the tubes as described above.

The crests of the ridge portion are provided with raised surface portions 17 affording slight elevations facing opposite in direction to the tendency of the yarn to slough off in order to avoid premature unwinding of the yarn convolutions wound upon the yarn carrier. A similar structure has been illustrated in the base portion of the bobbins as illustrated in U.S. Letters Pat. No. 3,138,345.

It is thus seen that an improved yarn carrier for dyeing and the like has been provided wherein improved longitudinal stability is imparted through the undulating surface configuration which also affords increased strength in longitudinal compression as well as radial strength. Moreover uniform dyeing with the avoidance of skips is insured.

While a preferred embodiment of the invention has been described using specific terms, such description is for illustrative purposes only and it is to be understood that changes and variations may be made without departing from the spirit or scope of the following claims.

What is claimed is:

1. A textile yarn carrier constructed of an open plastic shell having generally cylindrical configuration facilitating the passage of a liquid dye therethrough from the inside but being reduced adjacent at least one end sufficiently to permit stacking wherein an upper portion of each yarn carrier is nested within a lower portion of a next adjacent yarn carrier comprising:

a plurality of generally axial apexes with valleys therebetween formed by undulations within the surface of the plastic shell;

said plastic shell being of generally uniform thickness;

a plurality of spaced openings in said plastic shell;

said generally axial apexes with valleys therebetween formed by undulations extending along said yarn carrier;

said apexes and valleys of the top of one yarn carrier serving as means guiding an upper portion of said one yarn carrier into nested relation with respective apexes and valleys aligned in a lower portion of a next adjacent yarn carrier;

stop means carried inside said lower portion of a carrier limiting the amount to which said upper portion a yarn carrier may be pushed into said lower portion of another;

the apexes of the undulations being aligned in an axial direction such that the yarn carriers can be pushed into one another a predetermined amount forming nesting portions; and spaced recesses being formed on the apexes of the respective yarn carriers to avoid jamming.

2. The structure set forth in claim 1, wherein the apexes of the undulations are in an axial direction such that the yarn carriers can be pushed into one another a predetermined amount, spaced recesses being formed on the base in the inside of the apexes of the respective yarn carriers to avoid jamming.

3. The structure set forth in claim 1, wherein one or more stops are provided in the inside diameter for fixing the amount to which a yarn carrier may be inserted into another.

* * * * *